United States Patent [19]

Maldonado et al.

[11] Patent Number: 4,652,273

[45] Date of Patent: Mar. 24, 1987

[54] HYDROCARBON MIDDLE DISTILLATES COMPOSITION CONTAINING NITROGEN-CONTAINING ADDITIVES FOR DECREASING ITS CLOUD POINT

[75] Inventors: Paul Maldonado, Saint Symphorien d'Ozon; Robert Leger, Grigny; Choua Cohen, Lyons; Bernard Sillion, Rocquencourt, all of France

[73] Assignees: Institut Francais du Petrole, Rueil-Malmaison; Elf France, Massy, both of France

[21] Appl. No.: 737,133

[22] Filed: May 23, 1985

Related U.S. Application Data

[63] Continuation of Ser. No. 659,922, Oct. 11, 1985, abandoned, which is a continuation of Ser. No. 404,090, Jul. 30, 1982, abandoned.

[30] Foreign Application Priority Data

Jul. 30, 1981 [FR] France ..... 81 14870

[51] Int. Cl.[4] ..... C10L 1/22

[52] U.S. Cl. ..... 44/63; 44/71; 44/72

[58] Field of Search ..... 44/63, 71, 72

[56] References Cited

U.S. PATENT DOCUMENTS

| | | | |
|---|---|---|---|
| 3,272,746 | 9/1966 | Le Suer | 44/63 |
| 3,974,526 | 8/1976 | Dardik | 3/1.4 |
| 4,120,649 | 10/1978 | Schechter | 8/94.11 |

OTHER PUBLICATIONS

Hobson, G. D., "Modern Petroleum Technology", Applied Science Publishers, Ltd. 4th Ed., pp. 416–417.

*Primary Examiner*—Mrs. Y. Harris-Smith
*Attorney, Agent, or Firm*—Millen & White

[57] ABSTRACT

A hydrocarbon middle distillate contains an additive for decreasing its cloud point, obtained by reacting an aliphatic dicarboxylic compound selected from the maleic and alkylmaleic anhydrides, the alkenylsuccinic and polyalkenylsuccinic anhydrides and the corresponding dicarboxylic acids and lower alkyl diesters with a compound of the formula:

$$R—Z—(CH_2)_nNH]_mH$$

or $$HO—CH_2—R^5—NH_2$$

wherein R is a monovalent saturated aliphatic radical, Z is NR' or O, R' being hydrogen or an aliphatic radical, n is an integer from 2 to 4, m is zero or an integer from 1 to 4 and $R^5$ is a divalent saturated aliphatic radical.

11 Claims, No Drawings

HYDROCARBON MIDDLE DISTILLATES COMPOSITION CONTAINING NITROGEN-CONTAINING ADDITIVES FOR DECREASING ITS CLOUD POINT

This is a continuation of application Ser. No. 659,922 filed Oct. 11, 1985, which is a continuation of Ser. No. 404,090, filed July 30, 1982, now abandoned.

BACKGROUND OF THE INVENTION

The invention relates to new nitrogen additives which can be used as agents for decreasing the cloud point of hydrocarbon middle distillates (fues oils, gas oils), as well as to compositions of middle distillates containing said additives.

The oil distillates of interest in the invention are middle distillates (fuel oils, gas oils) whose distillation range (standard ASTM D 86-87) is between 150° C. and 450° C. Gas oils which are of more particular interest distill between an initial temperature from 160° C. to 190° C. and a final temperature from 350° C. to 390° C.

A great number of products sold on the market are designed to improve the limit filtrability temperature and the pour point of oil cuts of high paraffin content, for example:

polymers based on long chain olefins,
copolymers based on alpha-olefins,
ethylene-vinyl acetate copolymers,
N-acylaminoethylesters of acid-containing polymers, or halocarbon compounds.

These products act on the kinetic crystallization phenomena and change the crystal size, thus allowing the use of the suspension at a lower temperature without plugging of the pipes and the filters. The above products do not modify the temperature at which the first paraffin crystals appear. As a matter of fact, it has been considered, up to now, that this temperature was dependent on the molecular weight and the composition of the paraffins and on the nature of the solvent.

A decrease of the cloud point of middle distillates (particularly gas oils) by means of an additive would be highly beneficial to the refiners, since it would make it possible, without changing the distillation diagram, to comply with the standards which are presently subject to an increasing severity.

SUMMARY OF THE INVENTION

It has now been discovered that certain chemicals, whose definition is given hereinafter, when added to middle distillates, have the ability to make the first paraffin crystals appear at a lower temperature than that observed in the absence of these additives. This property is the more unobvious as it is still maintained after several cycles of heating and cooling and operates according to a mechanism which has not yet been explained.

This class of chemical compounds also has an action on other properties of middle distillates (particularly gas oils), by modifying the behavior of the medium which contains the precipitated paraffins.

Thus, the compounds proposed in this invention have a substantial affect on the limit filterability temperature and the pour point.

When paraffin crystals have formed by cooling, their normal tendency is to assemble by gravity at the bottom. This phenomenon, generally called settling, results in the plugging of ducts and filters and is detrimental to a safe use of middle distillates, particularly gas oils. The chemicals proposed in the invention can decrease substantially the settling rate of the paraffins formed by cooling of gas oils and other middle distillates.

Finally, the proposed products for having the above mentioned properties, also confer to the gas oils and middle distillates, to which they are added, anti-corrosion properties with respect to metal surfaces.

DETAILED DISCUSSION

As a general rule, the additives of the invention can be defined as products having an average molecular weight of about 300 to 10,000, obtained by condensation of at least one compound comprising a primary amine function, complying with one of the following general formulas (I) and (II):

$$R—Z\text{-}[(CH_2)_n NH]_m H \quad (I)$$

and $$HO—CH_2—R^5—NH_2 \quad (II)$$

with at least one dicarboxylic compound as hereinafter defined.

In formula (I), R is generally a monovalent saturated aliphatic radical comprising from 1 to 30 carbon atoms; Z can be, depending on the case, an oxygen atom or a divalent group of the type —NR'—, R' being either a hydrogen atom or a monovalent aliphatic radical; n is an integer from 2 to 4 and m may be zero or an integer from 1 to 4.

The compounds of the above formula (I) may consist of primary amines of the formula $R^1$—$NH_2$ (in that case, in formula (I), Z represents a —NH— group and the value of m is zero).

The radical $R^1$ is preferably linear and comprises from 12 to 30, particularly from 16 to 25 carbon atoms.

Specific examples of these amines are: dodecylamine, tetradecylamine, hexadecylamine, octadecylamine, eicosylamine and docosylamine, hexadecylamine and octadecylamine being preferred.

The compounds of the formula (I) may also consist of polyamines obtained from saturated aliphatic amines of the formula:

$$R^1—NH\text{-}[(CH_2)_n NH]_m H$$

corresponding to the general formula (I) wherein Z is a —NH— group; m may have a value from 1 to 4 and n a value from 2 to 4, preferably 3.

Preferably, the radical $R^1$ is linear and comprises from 12 to 30 and particularly from 16 to 25 carbon atoms.

Specific compounds are: N-dodecyl 1,3-diaminopropane N-tetradecyl 1,3-diamino propane, N-hexadecyl 1,3-diaminopropane, N-octadecyl 1,3-diamino propane, N-eicosyl 1,3-diaminopropane, N-docsyl 1,3-diaminopropane, N-hexadecyldipropylenetriamine, N-octadecyl dipropylenetriamine, N-eicosyldipropylenetriamine and N-docosyl dipropylenetramine. There are more advantageously used N-docosyl-, N-eicosyl-, N-octadecyl-, N-hexadecyl- or N-dodecyl 1,3-diamino propane, as well as N-hexadecyl- and N-octadecyl-dipropylenetriamine.

The compounds of formula (I) may also consist of polyamines of the formula:

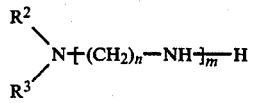

wherein $R^2$ and $R^3$, identical or different, are each an alkyl radical with 1 to 24 and preferably 8 to 22 carbon atoms, $R^2$ and $R^3$ preferably comprising together from 16 to 32 carbon atoms; n has a value from 2 to 4 and m a value from 1 to 4.

Specific compounds are: N,N-diethyl 1,2-diaminoethane, N,N-diisopropyl 1,2-diamino ethane, N,N-dibutyl 1,2-diaminoethane, N,N-diethyl 1,4-diaminobutane, N,N-dimethyl 1,3-diaminoethane, N,N-diethyl 1,3-diaminobutane, N,N-dioctyl 1,3-diaminobutane, N,N-didecyl 1,3-diaminobutane, N,N-didodecyl 1,3-diaminobutane, N,N-ditetradecyl 1,3-diaminobutane, N,N-dihexadecyl 1,3-diaminobutane, N,N-dioctadecyl 1,3-diamino propane, N,N-didodecyldipropylenetriamine, N,N-ditetradecyldipropylenetriamine, N,N-dihexadecyldipropylenetriamine and N,N-dioctadecyldipropylenetriamine.

Finally the compounds of formula (I) contemplated in this invention may consist of ether-amines, more particularly those complying with the formula:

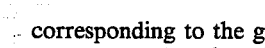

corresponding to the general formula (I) wherein Z is an oxygen atom; the radical $R^4$ comprises 1 to 24, preferably 8 to 22 carbon atoms, m is an integer from 1 to 24 and n an integer from 1 to 4, preferably 2 or 3.

Specific compounds of the ether-amine type are: 2-methoxy ethylamine, 3-methoxy propylamine, 4-methoxy butylamine, 3-ethoxy propylamine, 3-octyloxy propylamine, 3-decyloxy propylamine, 3-hexadecyloxy propylamine, 3-eicosyloxy propylamine, 3-docosyloxy propylamine, N-(3-octyloxy propyl) 1,3-diaminopropane, N-(3-decyloxy propyl) 1,3-diaminopropane, 3-(2,4,6-trimethyldecyloxy)propylamine and N-[3-(2,4,6-trimethyldecyloxy)-propyl]-1,3-diaminopropane.

The compound with a primary amine function which is used for preparing additives conforming to the invention may also consist of an aminoalcohol of formula (II):

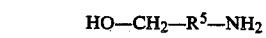

(II)

wherein $R^5$ is a divalent. saturated aliphatic radical, linear or branched, preferably linear, comprising 1 to 18 and preferably 10 to 18 carbon atoms.

Specific examples are: monoethanolamine, 1-amino 3-propanol, 1-amino 4-butanol, 1-amino 5-pentanol, 1-amino 6-hexanol, 1-amino 7-heptanol, 1-amino 8-octanol, 1-amino 10-decanol, 1-amino 11-undecanol, 1-amino 13-tridecanol, 1-amino 14-tetradecanol, 1-amino 16-hexadecanol, 2-amino 2-methyl 1-propanol, 2-amino 1-butanol and 2-amino 1-pentanol.

It must be understood that, without departing from the invention, it is possible to operate with one or more compounds of formula (I) and/or one or more compounds of formula (II).

The dicarboxylic compounds on which is effected the condensation of a compound of formula (I) or a compound of formula (II) such as described hereinbefore are more particularly selected from the anhydrides of aliphatic, preferably unsaturated, $\alpha,\beta$-dicarboxylic acids, such as, for example, maleic anhydride, alkylmaleic anhydrides, for example methylmaleic (or citraconic) anhydride, or from the alkenyl-succinic anhydrides, for example those obtained by reacting at least one $\alpha$-olefin, preferably linear, (having, for example, 10 to 30 carbon atoms) with maleic anhydride. Specific examples are n-octadecenyl succinic anhydride or dodecenyl succinic anhydride. It is obviously possible to use mixtures of two (or more) of these compounds.

It is also possible, according to the invention, to use polyalkenyl-succinic anhydrides, for example polyisobutenyl-succinic anhydrides, whose molecular weight is selected between 500 and 2000 and preferentially between 1000 and 1700. The manufacture of anhydrides of this type is well known in the prior art.

The above mentioned anhydrides may be replaced by the corresponding dicarboxylic acids, or by the lower alkyl diesters thereof (such as, for example, methyl, ethyl, propyl and butyl esters).

The compounds with a primary amine function of the formulas (I) and (II) are commonly used in a proportion of 1.02 to 1.2 mole, preferably 1.05 to 1.1 mole, per mole of the dicarboxylic compound. The compound with a primary amine function (I) or (II) may also be used in slight deficiency, down to 0.9 mole per mole of the dicarboxylic compound. The proportion is thus generally from 0.9 to 1.2 mole/mole.

The condensation of the compounds of formula (I) and/or (II) with the dicarboxylic compounds (for example dicarboxylic acids, esters or preferably anhydrides) may be effected without solvent; but preferably with a solvent, consisting more particularly of an aromatic or napheno-aromatic hydrocarbon having a boiling point of for example, from 70° to 250° C.: toluene, xylenes, diisopropylbenzene or an oil cut having the appropriate distillation range.

The additive compositions of the invention can be prepared, in practice, as follows: the compound of formula (I) and/or (II) is introduced progressively into a reactor containing the dicarboxylic compound, while maintaining the temperature between 30° and 80° C. The temperature is then raised to 120°–200° C. while eliminating the resultant volatile products (water or alcohols), either stripping with a stream of inert gas or by azeotropic distillation with the selected solvent; the content of dry substance is, for example, from 40 to 70% more often about 60%.

The reaction time, after addition of the reactants, is, for example, from 1 to 8 hours, preferably 3 to 6 hours.

The additives contemplated in this invention are particularly efficient for improving the cloud point of oil middle distillates (particularly gas oils), thus decreasing the temperature at which appear the first crystals of paraffin contained therein.

Although the action of these additives on the temperature at which the paraffin crystals appear in the middle distillates has not yet been clearly elucidated, a positive improvement i.e., a significant lowering of the cloud point of the middle distillates treated with these additives is observed, when the latter are added in a proportion of, for example, from 20 to 2000 g per ton of middle distillate. The preferred concentrations range from 100 to 2000 g/t. The decrease of the cloud point may reach, for example, 5° C., sometimes more.

It is also noteworthy that the additives of the invention, which improve efficiently the cloud point of middle distillates, also have the properties of inhibiting the settling of n-paraffins contained in middle distillates, also at rest, of improving the limit filterability temperature and the pour temperature and of inhibiting the corrosion of metal surfaces in contact with these distillates.

Thus, in the range of additive concentrations, from 20 to 2000 g per ton, it is possible to observe a decrease in the filterability temperature of, for example, up to 12° C. a decrease of the pour point of up to 20° C., a decrease of the proportion of settled paraffins and a clear anticorrosion effect particularly on ferrous metals.

The middle distillate compositions according to the invention may be prepared by directly admixing additives with the middle distillate.

It is however often advantageous to introduce them in the form of "mother-solutions" previously prepared in the above-mentioned solvents.

The "mother-solutions" can contain, for example, from 20 to 60% by weight of additive.

The following examples illustrate the invention and must not be considered as limitative thereof in any respect.

EXAMPLE 1

2,700 g of a polyamine of the trade (containing, in admixture, about 27% of palmityl 1,3 -propanediamine and 70% of stearyl 1,3 propanediamine, with a 370 g equivalent of primary amine) and 2,700 g of xylene are introduced into a 20 liter reactor provided with an efficient stirrer; the amine is dissolved at 50° C.; after cooling to 30° C., a solution of 699 g of maleic anhydride in 1,050 g of xylene is added, while maintaining the inner temperature at 40° C. The addition lasts one hour; heating at xylene reflux is then performed for 3 hours, the inner temperature being 144° C.; 157 g of water, corresponding to 128 g of reaction water and 29 g of water contained in the amine, are removed by distillation; once the reaction is complete, 500 g of xylene are distilled to obtain a 50% b.w. solution of additive I in xylene.

Additive I has been analyzed after evaporation of the solvent. Its molecular weight, by number, measured by tonometry, amounts to 1800. The thin layer infra-red spectrum shows the presence of imide bands at 1700 and 1780 $cm^{-1}$, secondary amide bands at 1635 and 1560 $cm^{-1}$ and a secondary amine band at 3300 $cm^{-1}$.

Additives II to VII have the same bands as additive I. Their molecular weights range between 1500 and 3000.

The activity of additive I is determined with two gas oil cuts of Aramco origin, whose characteristics are given in Table I below:

TABLE I

| | DISTILLATION ASTM IP°C. | DISTILLATION ASTM FP°C. | % DISTILLED AT 350° C. | DENSITY 15° C. IN (Kg/l) |
|---|---|---|---|---|
| Gas oil No. 1 | 181 | 382 | 89 | 0.846 |
| Gas oil No. 2 | 186 | 385 | 87 | 0.847 |

The effect of additive I on the decrease of the cloud point of each of the two gas oil cuts, in relation with the additive concentration, determined according to standard NF T 60105, is shown in Table II below.

TABLE II

| ADDITIVE CONCENTRATION (% b.w.) | CLOUD POINT (°C.) GAS OIL No. 1 | CLOUD POINT (°C.) GAS OIL No. 2 |
|---|---|---|
| 0 | +2 | +6 |
| 0.01 | +1 | +5 |
| 0.05 | 0 | +4 |

TABLE II-continued

| ADDITIVE CONCENTRATION (% b.w.) | CLOUD POINT (°C.) GAS OIL No. 1 | CLOUD POINT (°C.) GAS OIL No. 2 |
|---|---|---|
| 0.1 | −1 | +2 |
| 0.15 | −1 | +2 |
| 0.2 | −2 | +1 |

EXAMPLE 2

Additives differing mainly by the starting amine are used in an amount of 0.1% b.w. in the two gas oil cuts of example 1, the method of manufacture being the same as in example 1.

Additive I: product used in example 1;

Additive II: product obtained by condensing N-stearyldipropylene triamine with maleic anhydride:

Additive III: product obtained by condensing stearyl amine with maleic anhydride.

The results are given in Table III below:

TABLE III

| CLOUD POINT (°C.) | GAS OIL No. 1 | GAS OIL No. 2 |
|---|---|---|
| Additive-free | +2 | +6 |
| +0.1% additive I | −1 | +2 |
| +0.1% additive II | 0 | +3 |
| +0.1% additive III | +1 | +5 |

It is found that the effect of decreasing the cloud point is maximum in the case of additive I, wherein the starting amine is a mixture of two N-alkyl 1,3 propanediamines.

EXAMPLE 3

Additives differing essentially by the length of the alkyl chain of the starting amine are used in this example, in an amount of 0.1% b.w. in the same two gas oils as above.

There are thus used:

Additive I: product used in example 1:

Additive IV: product obtained by condensing N-behenyl 1,3 propane with maleic anhydride (behenyl=$C_{22}$)

Additive V: product obtained by condensing N-lauryl 1,3 propane with maleic anhydride (lauryl=$C_{12}$)

The results of the determinations of the cloud point are given in Table IV below

TABLE IV

| CLOUD POINT (°C.) | GAS OIL No. 1 | GAS OIL No. 2 |
|---|---|---|
| Additive-free | +2 | +6 |
| +0.1% additive I | −1 | +2 |
| +0.1% additive IV | −1 | +2 |
| +0.1% additive V | +1 | +5 |

It can be observed that the additive obtained from a diamine with an alkyl chain of 12 carbon atoms has a lower efficiency than the additives obtained from a diamine with a longer chain of 16, 18 or 22 carbon atoms.

EXAMPLE 4

Additives differing essentially by the nature of the starting dicarboxylic compound are used in this example, in a proportion of 0.1% b.w. in the same two gas oils as above.

There are thus used:

Additive I: product used in example 1, obtained from maleic anhydride.

Additive VI: product obtained by condensing N-stearyl 1,3 propane with methylmaleic (citraconic)anhydride.

Additive VII: product obtained by condensing N-stearyl 1,3 propane with n-octadecenyl succinic anhydride.

The determined cloud points are shown in Table V below:

TABLE V

| CLOUD POINT (°C.) | GAS OIL No. 1 | GAS OIL No. 2 |
|---|---|---|
| Additive-free | +2 | +6 |
| +0.1% additive I | −1 | +2 |
| +0.1% additive VI | 0 | +3 |
| +0.1% additive VII | 0 | +3 |

EXAMPLE 5

The inhibiting effect of an additive conforming to the invention on the settling of n-paraffins crystallizing in a gas oil cut maintained at rest at low temperature is determined in this example.

The additive is additive I already used above.

Two 100 cc test tubes are filled with the already used gas oil No. 2 (distillation range: IP=186° C., FP=385° C.).

No additive is introduced into the first test tube.

0.1% b.w. of additive is introduced into the second test tube.

The two test tubes are closed hermetically, then left at rest in a cold room at −10° C. for one week.

After one week, the settling rate of the settled paraffins expressed as the volume of the upper limpid phase, is reported in the following Table:

TABLE VI

| TEST TUBE No. 1 ADDITIVE-FREE GAS OIL | TEST TUBE No. 2 GAS OIL + ADDITIVE I |
|---|---|
| 50% vol | 15% vol |

All the precipitated paraffins are thus present in 50% by volume of the additive-free gas oil, which makes the lower portion more difficult to use as the result of the plugging of the pumps, filters and pipes.

As concerns the additive-containing gas oil, the upper limpid phase amounts to only 15%. The paraffins are thus in 85% of the total volume. They are in a state of better dispersion and can be transported more easily.

EXAMPLE 6

The effect of an additive conforming to the invention is tested, in this example, on the limit filterability temperature (LFT) of the two gas oil cuts described above.

The LFT values are determined according to standard NF M 07-042.

TABLE VII

| CONCENTRATION OF ADDITIVE I (% b.w.) | TLF GAS OIL No. 1 | TLF GAS OIL No. 2 |
|---|---|---|
| 0 | 0° C. | +3° C. |
| 0.15 | −8° C. | −5° C. |
| 0.20 | −9° C. | −9° C. |

EXAMPLE 7

The anti-corrosion effect of additive I of example 1 is tested in this example.

Product I has been used in the two gas oils No. 1 and No. 2, as hereinbefore described, at a concentration of 0.01% by weight.

The corrosion test consists of determining the rate of corrosion, by synthetic sea water, of cylindrical test pieces of polished steel or iron, according to the ASTM standard D 665 modified in the following manner:

The temperature is 32.2° C.; the test time is 20 hours.

The additive-free gas oils No. 1 and No. 2 cause 100% of the surface of the test pieces to rust; the two gas oils containing 0.01% b.w. of additive do not cause any rusting of the test pieces.

EXAMPLE 8

In this example, the effect of additive I, according to the invention, on the pour point of gas oil cuts is tested. The pour points are determined according to the French standard NFT 60105; The additive is tested in an amount of 0.1% by weight. The results are given in Table VIII below.

TABLE VIII

| GAS OIL | DISTILLATION ASTM IP° C. | DISTILLATION ASTM FP° C. | % DISTILLED AT 350° | DENSITY kg/l AT 15° C. | POUR POINT WITHOUT ADDITIVE | POUR POINT WITH ADDITIVE |
|---|---|---|---|---|---|---|
| No. 1 | 181 | 382 | 89 | 0.846 | −6° C. | −9° C. |
| No. 2 | 186 | 385 | 87 | 0.847 | −3° C. | −9° C. |
| No. 3 | 201 | 366 | 93 | 0.833 | −3° C. | −15° C. |
| No. 4 | 186 | 386 | 89 | 0.833 | −3° C. | −21° C. |

EXAMPLE 9

A solution consisting of 294 g (3 moles) of maleic anhydride dissolved in 500 g of xylene is introduced into a 3 liter reactor provided with a Dean and Stark water-separation system and an efficient stirrer. While maintaining the temperature of the solution between 30° and 40° C., a solution of 1230 g (3 moles) of N,N-didodecyl 1,3-diaminopropane in 1000 g of xylene is added thereto in 1.5 h. The whole is heated for 3 hours at xylene reflux, during time 55 g of water discharged from the reaction medium are collected. The reaction product constitutes additive VIII which is present as a solution is xylene at a concentration very close to 50% b.w.

EXAMPLE 10

Although operating as in example 9, 532 g (2 moles) of dodecenylsuccinic anhydride are condensed with 820 g (2 moles) of N,N-didodecyl 1,3-diaminopropane. The condensation product constitutes additive IX whose concentration in xylene is so adjusted as to attain 50% b.w.

EXAMPLE 11

In this example, use is made of a polyisobutenyl-succinic anhydride with a weight of 1200, corresponding to 0.90 anhydride group per 1000 g. According to the operating mode of example 9, 1200 g (1 mole) of this polyisobutenyl-succinic anhydride are condensed with a mixture of products consisting of 289 g (0.5 mole) of N,N dioctadecyl 1,3-diaminopropane and 40.8 g (0.4 mole) of N,N dimethyl 1,3-diaminopropane as a solution in xylene. The reaction product constitutes additive X; its xylene concentration is adjusted to 50% b.w.

The effect of the so-obtained additives VIII, IX and X has been tested on the cloud point (determined according to standard NF T 60-105), the limit filterability temperature (determined according to standard NF M 07-042) and the pour point (determined according to standard NF T 60-105) of the two gas oils No. 1 and No. 2, the concentration of the additive being 0.1% b.w. in each case.

The results are given in Table IX below:

TABLE IX

| | CLOUD POINT (°C.) | | T.L.F. (°C.) | | POUR POINT (°C.) | |
|---|---|---|---|---|---|---|
| ADDITIVES | $G_1$ | $G_2$ | $G_1$ | $G_2$ | $G_1$ | $G_2$ |
| 0.1% VIII | −1 | +3 | −4 | 0 | −9 | −9 |
| 0.1% IX | −2 | +2 | −5 | −3 | −12 | −9 |
| 0.1% X | −3 | +1 | −7 | −5 | −12 | −9 |
| Without | +2 | +6 | 0 | +3 | −6 | −3 |

EXAMPLE 12

294 g (3 moles) of maleic anhydride dissolved in 500 g of xylene are introduced into a stirred 3 l reactor, and the temperature is decreased to 30° C. A solution of 797 g (3.1 moles) of 3-(2,4,6-trimethyldecyloxy)propylamine in 324 g of xylene is added, while maintaining the temperature below 40° C. The addition lasts one hour, and heating is then performed for 3 hours at xylene reflux. The inner temperature is 144° C. 67 g of water are removed by distillation, corresponding to 54 g of reaction water and 13 g of water contained in the amine; after completion of the reaction, 200 g of dilution xylene are added to obtain a 50% b.w. solution of additive XI in xylene.

Additive XI has been analyzed after evaporation of the solvent. Its molecular weight by number, determined by tonometry, is 500. The thin layer infra-red spectrum shows imide bands at 1700 and 1780 $cm^{-1}$, secondary amide bands at 1635 and 1560 $cm^{-1}$ and an ether band at 1100 $cm^{-1}$.

The additives XII to XVI, whose manufacture is described in the following examples, show the same I.R. absorption bands as those of additive XI; their molecular weights are between 600 and 3000.

EXAMPLES 13 AND 14

The method of manufacture is the same as in example 12, with similar molar ratios, but the amine compounds differ.

EXAMPLE 13

Additive XII is obtained by condensing maleic anhydride with N-[3-(2,4,6-trimethyldecyloxy)propyl]-1,3-diaminopropane.

EXAMPLE 14

Additive XIII is obtained from the condensation product of maleic anhydride on a mixture comprising, by mole, 55% of ethanolamine and 45% of a N-alkyl propylenediamine cut of the trade, whose alkyl chains consist of about 27% of $C_{16}$ chain and 72% of $C_{18}$ chain (equivalent molecular weight: 370 per primary amine function).

EXAMPLES 15 TO 17

These examples are conducted according to the operating mode of example 12, the molar ratios of the reactants being the same as in example 12.

EXAMPLE 15

3-(2,4,6-trimethyldecyloxy)propylamine is condensed with a polyisobutenyl succinic anhydride whose weight is about 1000 and which has 0.675 anhydride function per 1000 g, thus producing additive XIV.

EXAMPLE 16

3-(2,4,6-trimethyldecyloxy)propylamine is condensed with an alkenyl succinic anhydride obtained by reacting equimolecular proportions of maleic anhydride and of a cut of linear α-olefins containing approximately 49% of $C_{20}$ olefin, 42% of $C_{22}$ olefin and 9% of $C_{24}$ olefin.

The result of this condensation is additive XV.

EXAMPLE 17

Ethanolamine is condensed with the alkenylsuccinic anhydride of example 16, the molar ratio of the ethanolamine to the anhydride content of the alkenylsuccinic anhydride being 1/1. Additive XVI is obtained.

In the above examples, the additives are obtained as a solution in xylene whose concentration is adjusted, so as to obtain 50% b.w. solutions of additive in xylene.

The activity of these additive compositions is tested by incorporating them, in a proportion of 0.1% b.w. of additive with respect to the gas oil, into the two gas oils cuts of ARAMCO origin, designated as $G_1$ and $G_2$, whose properties have been given above.

Three determinations have been performed on each of the so-formed compositions:

cloud point according to standard NF T 60-105 limit filterability temperature (LFT) according to standard NF M 07-042 pour point according to method NF T 60-105.

The results of these determinations are given in Table X below:

TABLE X

| | CLOUD POINT (°C.) | | TLF (°C.) | | POUR POINT (°C.) | |
|---|---|---|---|---|---|---|
| ADDITIVES | $G_1$ | $G_2$ | $G_1$ | $G_2$ | $G_1$ | $G_2$ |
| Without | +2 | +6 | 0 | +3 | −6 | −3 |
| 0.1% XI | −1 | +3 | −6 | −2 | −9 | −6 |
| 0.1% XII | −1 | +3 | −3 | 0 | −12 | −9 |
| 0.1% XIII | −2 | +3 | −7 | −5 | −12 | −9 |
| 0.1% XIV | −1 | +3 | −3 | 0 | −9 | −9 |
| 0.1% XV | −3 | +2 | −8 | −4 | −24 | −21 |
| 0.1% XVI | −2 | +2 | −8 | −5 | −21 | −18 |

EXAMPLE 18

The inhibiting effect of an additive according to the invention on the settling of n-paraffins crystallizing in a gas oil cut maintained at rest at low temperature is tested in this example.

Two 100 cc test tubes are filled with the previously used gas oil No. 2 (distillation range IP=186° C., FP=385° C.).

No additive is introduced into the first test tube.

0.1% b.w. of additive XI is introduced into the second test tube. The two test tubes are hermetically closed and left at rest in a cold room at −10° C. for one week.

After one week, the settling rate of the settled paraffins, expressed as the volume of the limpid upper phase, is noted in the following Table:

TABLE XI

| TEST TUBE No. 1 ADDITIVE-FREE GAS OIL | TEST TUBE No. 2 GAS OIL + ADDITIVE XI |
|---|---|
| 50% vol. | 15% vol. |

All the precipitated paraffins are present in 50% of the volume of the additive-free gas oil, which makes the lower portion thereof more difficult to use, as a result of the pumps, filters and pipes plugging.

There is only 15% of limpid upper phase in the additive-containing gas oil. The paraffins are contained in 85% of the total volume. They are better dispersed and can be transported more easily.

EXAMPLE 19

The anti-corrosion effect of additive XI of example 12 is tested in this example.

Product XI has been used in the two already described gas oils $G_1$ and $G_2$ at a concentration of 0.01% b.w.

The corrosion test consists of examining the corrosion rate of cylindrical polished steel or iron test pieces, caused by synthetic sea water, according to standard ASTM D 665 modified as follows: the temperature is 32.2° C. and the test time is 20 hours.

The two additive-free gas oils $G_1$ and $G_2$ give test pieces rusted on 100% of their surface, and the two gas oils containing 0.01% b.w. of additive give test pieces totally free of rust.

What is claimed is:

1. A method for lowering the cloud point of a middle distillate oil, comprising admixing with said oil at least one additive in a minor amount effective to lower the cloud point of said oil, said additive having a molecular weight of 300 to 10,000, and being the reaction product of (1) at least one aliphatic dicarboxylic compound, being maleic anhydride, and alkylmaleic anhydride, an alkenylsuccinic anhydride, polyalkenyl succinic anhydride or the corresponding dicarboxylic acid or lower alkyl diester with (2) at least one compound having the general formula:

$$R—Z\text{-}[(CH_2)_nNH]_mH \quad (I)$$

or $$HO—CH_2—R^5—NH_2 \quad (II)$$

wherein R represents a monovalent saturated aliphatic radical of 1 to 30 carbon atoms; Z is O or NR′, wherein R′ is a hydrogen atom or a monovalent saturated aliphatic radical containing 1 to 30 carbon atoms; n is an integer from 2 to 4, m is zero or an integer from 1 to 4; and $R^5$ is a divalent saturated aliphatic radical having from 1 to 18 carbon atoms; the molar ratio of said amine (2) to said dicarboxylic compound (1) being 0.9–1.2.

2. A method according to claim 1, wherein at least one aliphatic dicarboxylic compound (1) is maleic anhydride, an alkylmaleic anhydride, an alkenyl succinic anhydride, the alkenyl radical being linear and having 10–30 carbon atoms, a polyalkenyl succinic anhydride having a molecular weight of about 500–2000, or the corresponding dicarboxylic acid or lower alkyl diester, and said at least one compound (2) is a mono-amine of the formula a polyamine of the formula $$R^1—NH\text{-}[(CH_2—NH]_mH,$$

a polyamine of the formula

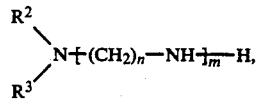

an ether-amine of the formula $$R^4—O\text{-}[(CH_2)_nNH]_mH,$$

or an amino-alcohol of the formula $$HO—CH_2—R^5—NH_2,$$

wherein $R^1$ is a linear alkyl radical of 12–30 carbon atoms, $R^2$ and $R^3$ are each a linear alkyl rardical of 8–22 carbon atms, $R^4$ is an alkyl radical of 8–22 carbon atoms, $R^5$ is an alkylene radical of 1–18 carbon atoms, m being a integer from 1 to 4.

3. A method according to claim 2, wherein said mono-amine is dodecylamine, tetradecylamine, hexadecylamine, octadecylamine, eicosylamine or docosylamine.

4. A method according to claim 2, wherein said polyamine is N-dodecyl 1,3-diaminopropane, N-tetra-decyl 1,3-diaminopropane, N-hexadecyl 1,3-diaminopropane, N-octadecyl 1,3-diaminopropane, N-eicosyl 1,3-diaminopropane, N-docosyl 1,3-diaminopropane, N-hexadecyldipropylenetriamine, N-octadecyl dipropylenetriamine, N-eicosyldipropylenetriamine or N-docosyl dipropylenetriamine.

5. A method accordig to claim 2, wherein said polyamine is N,N-dioctyl 1,3-diaminopropane, N,N-didecyl 1,3-diaminopropane, N,N-didodecyl 1,3-diaminopropane, N,N-ditetradecyl 1,3-diaminopropane, N,N-dihexadecyl 1,3-diaminopropane, N,N-dioctadecyl 1,3-diaminopropane, N,N-didodecyldipropylenetriamine, N,N-ditetradecyldipropylenetriamine, N,N-dihexadecyldipropylenetriamine or N,N-dioctadecyldipropylenetriamine.

6. A method according to claim 2, wherein said ether-amine is 3-octyloxy propylamine, 3-decyloxy propylamine, 3-hexadecyloxy propylamine, 3-eicosyloxy propylamine, 3-dicosyloxy propylamine N-(3-octyloxy propyl) 1,3-diaminopropane, N-(3-decyloxy propyl) 1,3-diaminopropane, 3-(2,4,6-trimethyldecyloxy)-propylamine or N-[3-(2,4,6-trimethyldecyloxy)propyl]-1,3-diaminopropane.

7. A method according to claim 2, wherein said aminoalcohol is monoethanolamine, 1-amino 3-propanol, 1-amino 4-butanol, 1-amino 5-pentanol, 1-amino 6-hexanol, 1-amino 7-heptanol, 1-amino 8-octanol, 1-amino 10-decanol, 1-amino 11-undecanol, 1 amino 13-tridecanol, 1-amino 14-tetradecanol, 1-amino 16-hexadecanol, 2-amino 2-methyl 1-propanol, 2-amino 1-butanol or 2-amino 1-pentanol.

8. A method according to claim 1, wherein said aliphatic dicarboxylic compound is maleic anhydride, methylmaleic anhydride, n-octadecenylsuccinic anhydrides, dodencenyl succinic anhydride, a polyisobutenylsuccinic anhydride or a mixture thereof.

9. A method according to claim 1, wherein said additive is prepared by the reaction comprising admixing, at a temperature of 30° to 80° C., said dicarboxylic compound with said compound of formula (I) or (II) and heating the resultant mixture at a temperature of 120° to 200° C. for 1 to 8 hours with removal of resultant water or alcohol.

10. A method according to claim 1, wherein said middle distillate oil has a distillation range from 150° to 450° C.

11. A method according to claim 1, wherein said amount is 20–2,000 g/ton of oil.

* * * * *

UNITED STATES PATENT AND TRADEMARK OFFICE

CERTIFICATE OF CORRECTION

PATENT NO. : 4,652,273

DATED : March 24, 1987

INVENTOR(S) : Paul Maldonado et al

It is certified that error appears in the above-identified patent and that said Letters Patent is hereby corrected as shown below:

Title Page, (73) Assignees- reads"Elf France, Massy,"
Should read--Elf France, Paris,--

Title Page, (63) Rel. U.S. Appli. Data- Reads: "October 11, 1985"
Should read --October 11, 1984--

Column 11, Claim 1, Line 48:
Reads: "being maleic anhydride, and alkylmaleic anhydride, an"
Should read --being maleic anhydride, an alkylmaleic anhydride, an--

Column 11, Claim 1, Line 49:
Reads: "alkenylsuccinic anhydride, polyalkenyl succinic anhy-"
Should read --alkenylsuccinic anhydride, a polyalkenyl succinic anhy- --

UNITED STATES PATENT AND TRADEMARK OFFICE

CERTIFICATE OF CORRECTION

PATENT NO. : 4,652,273

DATED : March 24, 1987

INVENTOR(S) : Paul Maldonado et al

It is certified that error appears in the above-identified patent and that said Letters Patent is hereby corrected as shown below:

Column 11, Claim 2, Line 67:

reads "2. A method according to claim 1, wherein at least'

Should read --2. A method according to claim 1, wherein said at least--

Column 12, Claim 2, Line (between 7 & 8):

should read --$R^1NH_2$--

Column 12, Claim 2, Line 10:

reads "$R^1$-NH--($CH_2$-NH--$_m$H,"

should read --$R^1$-NH--$(CH_2)_n$-NH--$_m$H,--

Column 12, Claim 2, Line 31:

reads "a integer from 1 to 4."

should read --an integer from 1 to 4.--

UNITED STATES PATENT AND TRADEMARK OFFICE

CERTIFICATE OF CORRECTION

PATENT NO. : 4,652,273

DATED : March 24, 1987

INVENTOR(S) : Paul Maldonado et al

It is certified that error appears in the above-identified patent and that said Letters Patent is hereby corrected as shown below:

Column 12, Claim 6, Line 57:

Reads: "pylamine, 3-dicosyloxy propylamine N-(3-oct -yloxy"

should read: --Pylamine, 3-docosyloxy propylamine N-(3-octy loxy--

UNITED STATES PATENT AND TRADEMARK OFFICE

CERTIFICATE OF CORRECTION

PATENT NO. : 4,652,273

DATED : March 24, 1987

INVENTOR(S) : Paul Maldonado et al

It is certified that error appears in the above-identified patent and that said Letters Patent is hereby corrected as shown below:

Column 12, Claim 7, Line 67:

Reads: "10-decanol, 1-amino 11-undecanol, 1 amino 13-"

should read: --10-decanol, 1-amino 11-undecanol, 1-amino 13- --

Column 13, Claim 8, Line 6:

Reads: "drides, dodencenyl succinic anhydride, a poly-isobute-"

should read-- --drides, dodecenyl succinic anhydride, a poly-isobute- --

Signed and Sealed this

Eleventh Day of August, 1987

*Attest:*

DONALD J. QUIGG

*Attesting Officer*

*Commissioner of Patents and Trademarks*